US007723554B2

(12) United States Patent
Arca et al.

(10) Patent No.: US 7,723,554 B2
(45) Date of Patent: May 25, 2010

(54) PROCESS FOR THE SELECTIVE CATALYTIC HYDRODEALKYLATION OF ALKYLAROMATIC HYDROCARBONS

(75) Inventors: Vittorio Arca, Chioggia-Venezia (IT); Angelo Boscolo Boscoletto, Sottomarina-Venezia (IT)

(73) Assignee: Polimeri Europa S.p.A., Brindisi (IT)

( * ) Notice: Subject to any disclaimer, the term of this patent is extended or adjusted under 35 U.S.C. 154(b) by 713 days.

(21) Appl. No.: 10/594,076

(22) PCT Filed: Feb. 8, 2005

(86) PCT No.: PCT/EP2005/001259

§ 371 (c)(1),
(2), (4) Date: Jan. 22, 2007

(87) PCT Pub. No.: WO2005/090525

PCT Pub. Date: Sep. 29, 2005

(65) Prior Publication Data

US 2007/0203378 A1 Aug. 30, 2007

(30) Foreign Application Priority Data

Mar. 23, 2004 (IT) ..... MI2004A0554

(51) Int. Cl.
*C07C 4/18* (2006.01)

(52) U.S. Cl. ..... 585/489; 585/488

(58) Field of Classification Search ..... 585/488, 585/489
See application file for complete search history.

(56) References Cited

U.S. PATENT DOCUMENTS 6,063,975 A * 5/2000 Drake et al. ..... 585/418

FOREIGN PATENT DOCUMENTS

EP 0 138 617 2/1985

OTHER PUBLICATIONS

U.S. Appl. No. 12/375,830, filed Jan. 30, 2009, Arca, et al.
U.S. Appl. No. 10/586,586, filed Jul. 20, 2006, Arca, et al.

* cited by examiner

*Primary Examiner*—Thuan Dinh Dang
(74) *Attorney, Agent, or Firm*—Oblon, Spivak, McClelland, Maier & Neustadt, L.L.P.

(57) ABSTRACT

Process for the catalytic hydrodealkylation alone of hydrocarbon compositions comprising $C_8$-$C_{13}$ alkylaromatic compounds, optionally in a mixture with $C_4$-$C_9$ aliphatic and cycloaliphatic products, including the treatment in continuous of said hydrocarbon compositions, in the presence of water, with a catalyst consisting of a ZSM-5 zeolite as such or in bound form, wherein the molar ratio Si/Al in the ZSM-5 ranges from 5 to 35, modified with at least one metal selected from those belonging to groups IIB, VIB and VIII, at a temperature ranging from 400 to 700° C., a pressure of between 2 and 4 MPa, a molar ratio between water and the charge in the feed to the reactor ranging from 0.0006 to 0.16 (i.e. between 0.01 and 2.5% w/w) and a molar ratio $H_2$/charge of between 3 and 6.

20 Claims, 1 Drawing Sheet

Figure 1:
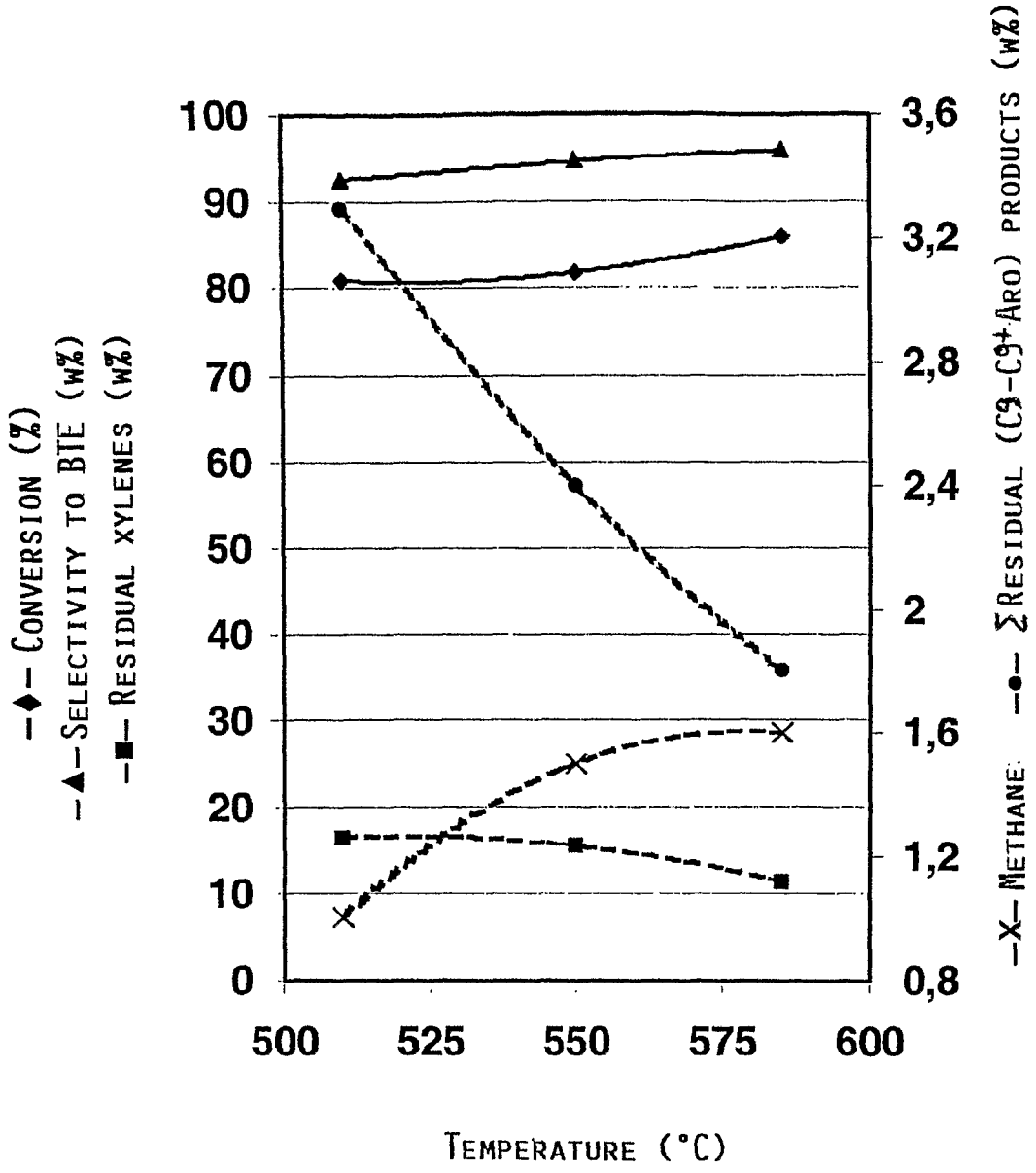

PROCESS FOR THE SELECTIVE CATALYTIC HYDRODEALKYLATION OF ALKYLAROMATIC HYDROCARBONS

The present invention relates to a process for the catalytic hydrodealkylation of alkylaromatic hydrocarbons.

More specifically, the present invention relates to a process for the catalytic hydrodealkylation of hydrocarbon compositions comprising $C_8$-$C_{13}$ alkylaromatic compounds, optionally in a mixture with $C_4$-$C_9$ aliphatic and cycloaliphatic products.

Even more specifically, the present invention relates to a process for the catalytic hydrodealkylation of alkylaromatic hydrocarbons, in a mixture with aliphatic products, wherein the reaction takes place in the presence of water. The presence of water, together with the choice of suitable operative conditions and catalyst formulation, make the reaction, object of the invention, surprisingly selective towards the hydrodealkylation of alkylaromatic products, and efficient in quantitatively suppressing transalkylation, isomerization, disproportioning and condensation side-reactions.

This leads to a high yield in benzene, toluene and ethane (BTE) and reduced or non-formation of both methane and condensed products, essentially naphthalene and biphenyl products.

Processes for the catalytic conversion of alkylaromatic products are known in literature, wherein the addition of water under the process conditions, specifically promotes isomerization, disproportioning and transalkylation reactions, significantly jeopardizing the hydrodealkylation reaction, thus obtaining opposite results to those object of the present invention.

U.S. Pat. No. 4,431,857, for example, describes a catalytic process, carried out in the presence of a crystalline boron-silicate catalyst (AMS-1B) impregnated with molybdenum, wherein the addition of water, from 50 to 2000 ppm, to the feeding mix consisting of xylenes (ortho- meta- and para-) and ethylbenzene, causes their isomerization to para-xylene, thus inhibiting the direct dealkylation.

U.S. Pat. No. 5,773,679, describes a process for the catalytic conversion selectively directed towards the disproportioning reaction of toluene to para-xylene by the addition of water, in continuous or intermittently (from 0.01 to 10 ml*g/min), to the feeding mix, using a ZSM-5 zeolite treated with a silanizing agent. The ethylbenzene, initially present, and the heavier alkylaromatic products which are formed, however, do not undergo dealkylation under the reaction conditions.

U.S. Pat. No. 6,512,155 describes a sole isomerization process carried out in the presence of water (from 75 to 750 ppm) in order to bring mixtures of xylenes, under non-equilibrium conditions, together with ethylbenzene, towards the selective production of p-xylene, so as to have a final equilibrium composition of xylenes. The reaction proceeds in the presence of a zeolitic or non-zeolitic catalyst impregnated with Pt, and water is added in continuous or intermittently, as such or by means of an organic precursor (alcohol, ester, ether) capable of supplying it under the reaction conditions.

U.S. Pat. No. 6,500,997 describes a process for the conversion of $C_7$-$C_{10}$ alkylaromatic products via disproportioning/transalkylation, to obtain mainly xylenes, with an equilibrium composition, carried out on a catalyst based on mordenite or β-zeolite impregnated with bismuth. In this case, the presence of water in the reaction is undesired, but the system guarantees, according to the invention, the maintenance of a high stability and activity even when water is present up to 500 ppm.

As far as the operative conditions and choice of catalyst are concerned, European patent 138,617 describes a process for the conversion of aromatic hydrocarbons by means of hydrodealkylation which comprises the treatment of a hydrocarbon stream, essentially consisting of ethylbenzene and xylenes, under conventional reaction conditions, with a zeolite catalyst modified with molybdenum. In the process described, the general reaction conditions do not allow a hydrodealkylation reaction without contemporaneous isomerization, transalkylation, disproportioning and condensation reactions. The limitations towards a selective catalytic hydrodealkylation also emerge from various other processes described in the known art. In some cases, this reaction even forms a side-reaction with respect to the isomerization, transalkylation, disproportioning and condensation reactions.

The Applicant has now unexpectedly found that it is possible to induce the catalytic hydrodealkylation reaction alone, in the presence of water, of $C_8$-$C_{13}$ alkylaromatic hydrocarbons to benzene, toluene and ethane (BTE), without contemporaneous isomerization, transalkylation, disproportioning and condensation reactions, by selecting suitable operative conditions and catalyst formulation.

In particular, the presence of water and the catalyst composition, both object of the present invention, have surprisingly allowed the selection of operative conditions so as to favour the hydrodealkylation alone of alkylaromatic compounds. According to the process, object of the invention, not only is the hydrodealkylation reaction quantitatively selective towards the formation of benzene, toluene and ethane, with a reduced or null production of methane and condensed products (naphthalene and biphenyl derivatives), but the benzene/toluene ratio is always decidedly favorable towards benzene. The economical aspect of the process can therefore be referred to the intrinsic value of both the reaction streams: the liquid phase due to the remunerative value of benzene and toluene, with particular reference to benzene, always produced in larger quantities than toluene; the gaseous phase as a result of the possibility of recycling the ethane produced to any pyrolysis process, for example by recycling to ovens, with the considerable energy recovery guaranteed by this type of recycling.

An object of the present invention therefore relates to a process for the catalytic hydrodealkylation alone of hydrocarbon compositions comprising $C_8$-$C_{13}$ alkylaromatic compounds, possibly mixed with $C_4$-$C_9$ aliphatic and cycloaliphatic products, which comprises the treatment, in continuous, in the presence of water, of said hydrocarbon compositions with a catalyst consisting of a ZSM-5 zeolite carrier having a molar ratio Si/Al of between 5 and 35, modified with at least one metal selected from those belonging to groups IIb, VIB and VIII, at a temperature ranging from 400 to 700° C., preferably between 450 and 600° C., a pressure ranging from 2 to 4 MPa, preferably between 2.8 and 3.6 MPa, a molar ratio between water and hydrocarbon charge ranging from 0.0006 to 0.16 (i.e. between 0.01 and 2.5% w/w), more preferably between 0.003 and 0.032 (i.e. between 0.05 and 0.5% w/w), a molar ratio $H_2$/charge of between 3 and 6, preferably between 3.8 and 5.2.

According to the present invention, the hydrocarbon charge which undergoes hydrodealkylation comprises $C_8$-$C_{13}$ alkylaromatic compounds, such as ethylbenzene, xylene, diethylbenzenes, ethylxylenes, trimethylbenzenes, tetramethylbenzenes, propylbenzenes, ethyltoluenes, propyltoluenes etc. This charge can come, for example, from effluents of reforming units or units which effect pyrolytic processes, such as steam cracking, and can possibly contain a mix of $C_4$-$C_9$ aliphatic and cycloaliphatic products and organic compounds containing heteroatoms, such as, for example, sulfur, in the typical amounts generally present in charges deriving from reforming units or pyrolysis processes.

The hydrocarbon charge used in the present process can also be subjected to separation treatment, for example distillation or extraction, to concentrate the products which must subsequently undergo hydrodealkylation, or it can be treated with aromatization processes to increase the concentration of alkylaromatic compounds and decrease the paraffin concentration. Furthermore, a previous hydrogenation of the charge may also be necessary, to eliminate the unsaturations present in the aliphatic compounds and on the same alkyl substituents of the aromatic rings. The same hydrogenation can remove sulfur, nitrogen or oxygen from the substances typically present in the charge to be treated, even if this latter aspect is not of particular importance as, under the catalytic hydrodealkylation conditions, according to the present invention, these heteroatoms are quantitatively removed (sulfur, for example, as $H_2S$).

The hydrodealkylation catalyst, according to the present invention, consists of a ZSM-5 zeolite modified with at least one metal selected from those of groups IIB, VIB and VIII. Molybdenum is preferred among the metals, object of the invention, used either singly or in pairs. The composition of the zeolite carrier is particularly important for the embodiment of the present invention, which comprises the hydrodealkylation of alkylaromatic compounds with the substantial absence of isomerization, transalkylation, disproportioning and condensation side-reactions. It has been verified that the use of a ZSM-5 zeolite with a high aluminum content, in particular having Si/Al molar ratios of between 5 and 35, preferably between 15 and 30, contributes to obtaining the desired result.

ZSM-5 zeolites are available on the market or can be prepared according to the methods described in U.S. Pat. Nos. 3,702,886 and 4,139,600. The structure of ZSM-5 zeolites is described by Kokotailo et al. (Nature, Vol. 272, page 437, 1978) and by Koningsveld et al. (Acta Cryst. Vol. B43, page 127, 1987; Zeolites, vol. 10, page 235, 1990).

In the process of the present invention, the zeolite catalyst is preferably used in bound form, adopting a binding compound capable giving it form and consistency, for example mechanical resistance, so that the zeolite catalyst/binder can be conveniently used in an industrial reactor. Examples of binders include aluminas, among which pseudo-bohemite and γ-alumina; clays, among which kaolinite, vermiculite, attapulgite, smectites, montmorillonites; silica; alumino-silicates; titanium and zirconium oxides; combinations of two or more thereof, used such quantities as to have zeolite/binder weight ratios ranging from 100/1 to 1/10.

The dispersion of metals in the zeolite or zeolite/binder catalyst can be carried out according to conventional techniques, such as impregnation, ion exchange, vapor deposition, or surface adsorption. The incipient impregnation technique is preferably used, with an aqueous or aqueous-organic solution (the organic solvent being preferably selected from alcohols, ketones and nitrites or mixtures thereof), containing at least one hydro- and/or organo-soluble of the metal, with a final total content of the metal in the catalyst ranging from 0.5 to 10% by weight.

The zeolite, with or without a binder, is subjected to impregnation with a metal of groups IIB, VIB and VIII, in particular, molybdenum.

The bound or non-bound catalyst can be treated according to methods which include:

preparing one or more solutions of compounds of the metals to be carried;

impregnating the zeolite with the above solutions;

drying the zeolite thus impregnated:

calcining the zeolite, impregnated and dried, at temperatures of between 400 and 650° C.;

possibly repeating the above steps several times, according to necessity.

Examples of compounds of the metals used are: molybdenum(II) acetate, ammonium(VI) molybdate, diammonium (III) dimolybdate, ammonium (VI) heptamolybdate, ammonium (VI) phosphomolybdate and analogous salts of sodium and potassium, molybdenum(III) bromide, molybdenum (III)-(V) chloride, molybdenum(VI) fluoride, molybdenum (VI) oxychloride, molybdenum(IV)-(VI) sulfide, molybdic acid and the corresponding acidic salts of ammonium, sodium and potassium, and molybdenum(II-VI) oxides.

At the end of the impregnation, the total metal content, alone or in pairs, in the catalyst ranges from 0.1 to 10% by weight, preferably from 0.5 to 8% by weight.

Once the preparation of the catalyst has been completed, the same is charged into a fixed-bed reactor, fed in continuous with the hydrocarbon charge, hydrogen and water. The water is fed, according to convenience, either already vaporized, so that it can be mixed directly with the hydrocarbon charge, previously brought to gas phase, or by the addition of a carrier compound, miscible with the liquid charge, capable of releasing it under the reaction conditions.

Among compounds miscible with the liquid hydrocarbon charge, alcohols, ethers and esters can be used. Alcohols are preferred, and among these ethanol or phenethyl alcohol. For example, ethyl alcohol releases the water desired and ethylene, under the reaction conditions. The latter is immediately hydrogenated to ethane, adding it to the amount present in the gas phase selectively produced by the hydrodealkylation reaction.

Among the fundamental experimental parameters, the selection of the flow rate of the reagents is of vital importance in order to obtain a selective hydrodealkylation of the $C_8$-$C_{13}$ aromatic hydrocarbons possibly in a mixture with $C_4$-$C_9$ aliphatic and cycloaliphatic hydrocarbons. The feeding rates of the hydrocarbon, water and hydrogen mix, or of the carrier compound, must therefore be such as to guarantee an LSHV (Liquid Hourly Space Velocity), calculated on the hydrocarbon stream, ranging from 3 to 5 $h^{-1}$ and, more preferably, between 3.5 and 4.5 $h^{-1}$.

For this purpose, the molar ratio between hydrogen and the charge fed to the reactor must remain within the range of 3 to 6 mol/mol, more preferably between 3.8 and 5.2 mol/mol. In particular, the molar ratio between the water and hydrocarbon charge fed to the reactor is between 0.0006 and 0.16 (i.e. between 0.01 and 2.5% w/w), more preferably between 0.003 and 0.032 (i.e. between 0.05 and 0.5% w/w).

The experimental apparatus for the reaction includes a stainless steel fixed-bed reactor with an internal diameter of 20 mm and a total height of 84.5 cm, an electric heating device surrounding the reactor, a cooling system, a gas-liquid separator and a liquid high pressure pump.

The isothermal section of the reactor, maintained at a constant temperature by automatic control, is charged with the catalyst. The remaining reactor volume is filled with an inert solid in granules, for example, corundum, in order to guarantee an optimal distribution and mixing of the gaseous reagent flow before the catalytic bed and the heat supplied to the reaction.

A pre-heater, positioned before the reactor, which operates at a temperature ranging from 200 to 400° C., more preferably between 250 and 320° C., contributes to the optimal contact of the reagents in gaseous phase (hydrocarbon mix, water and hydrogen) with the catalyst. This system favours the establishment of isothermal conditions in very rapid times, not only limited to the fixed-bed, but also along the whole reactor, allowing an easier and more accurate control of the operating temperature of the catalyst. The liquid and gaseous effluents produced by the reaction are separated and analyzed via gas chromatography, at intervals.

The following examples provide a further illustration of the process according to the present invention and should in no way be interpreted as limiting its scope as indicated in the enclosed claims.

REFERENCE EXAMPLE FOR THE CATALYST PREPARATION

Catalyst A (Comparison)

A catalyst A is prepared, obtained by mixing a ZSM-5 zeolite and an alumina as binder, the two phases being in a weight ratio of 60/40, and extruding the mixture.

The extruded product is calcined in air at 550° C. for 5 hours and its surface area BET is 290 $m^2/g$.

Once at room temperature, the above is crushed and sieved to produce a powder having dimensions of between 20 and 40 mesh (between 0.84 mm and 0.42 mm), so that 12.4 g of catalyst powder have an equivalent volume of 20 ml.

Catalyst B

Catalyst B is obtained by impregnating catalyst A (50 g) with an aqueous solution (60 ml) containing 1.88 g of ammonium molybdate $[(NH_4)_6Mo_7O_{24}.4H_2O]$ at about 25° C. for 16 hours, and is subsequently placed under a nitrogen flow for 12 hours, dried in an oven at 120° C. for 4 hours under vacuum and calcined in air at 550° C. for 5 hours. The calculated molybdenum content is 2.0% by weight, against the value of 2.1% by weight determined by means of ICP-MS analysis.

Examples 1-9

The reactor is charged with 20 $cm^3$ (12.4 g) of catalyst A, whereas the remaining volume is filled with granules of corundum to guarantee the optimal distribution and mixing of the gaseous flow of the reagents and of the heat supplied to the reaction.

The hydrocarbon charges, whose compositions are indicated in Table 1, are fed to the reactor suitably mixed with hydrogen. The aliphatic fraction in the charge consists of $C_4$-$C_9$ products and the saturated $C_5$ indane ring. The ethanol present in Charge 2 in an amount of 5% w/w supplies a quantity of equivalent water of 1.95% w/w.

TABLE 1

Composition of the feeding charge

| Concentration | Charge type: Charge 1 weight % | Charge type: Charge 2 weight % |
|---|---|---|
| Ethanol ($H_2O$ as carrier) | — | 5 |
| Ethylbenzene | 34 | 32.3 |
| o, m, p-xylene | 32 | 30.4 |
| Indane | 9 | 8.6 |
| Cumene | 1 | 0.9 |
| n-propylbenzene | 3 | 2.9 |
| 2-, 3-, 4-ethyltoluene | 16 | 15.2 |
| Σ ($C_4$-$C_9$ Aliph. + $C_{9+}$ Arom.) | 5 | 4.7 |
| Total | 100 | 100 |

The reaction is carried out at a pressure of 3 MPa with a flow-rate of the reagent charge which is such as to have an LHSV of 3.9-4.1 $h^{-1}$, and a molar ratio $H_2$/charge of 4.2-4.4. The results are indicated in the following table 2.

TABLE 2

| | Example 1 | 2 | 3 | 4 | 5 | 6 | 7 | 8 |
|---|---|---|---|---|---|---|---|---|
| Reaction temperature | 510° C. | 510° C. | 510° C. | 510° C. | 550° C. | 550° C. | 550° C. | 550° C. |
| Catalyst | A | A | B | B | A | A | B | B |
| Charge | 1 | 2 | 1 | 2 | 1 | 2 | 1 | 2 |
| Charge conversion (%) | 78.6 | 76.4 | 84.5 | 80.9 | 81.3 | 76.1 | 88.7 | 81.8 |
| Liquid effluent composition | weight % | weight % | weight % | weight % | weight % | weight % | weight % | weight % |
| Methane | 10.3 | 2.6 | 3.2 | 1.0 | 13.8 | 2.7 | 7.0 | 1.5 |
| Ethane (E) | 11.2 | 6.8 | 20.6 | 14.8 | 11.4 | 9.7 | 19.2 | 15.4 |
| Σ C3 | 3.1 | 7.8 | 3.8 | 3.3 | 1.3 | 7.5 | 2.2 | 2.5 |
| Σ C4-C5 | . . . | 0.2 | 0.1 | 0.1 | . . . | 0.2 | 0.1 | 0.1 |
| Ethyl benzene | 0.9 | 2.8 | 0.2 | 1.0 | 0.8 | 3.5 | 0.1 | 0.6 |
| o, m, p-xylene | 15.9 | 20.2 | 13.1 | 16.4 | 14.5 | 21.3 | 10.0 | 15.5 |
| Indane | . . . | . . . | . . . | . . . | . . . | . . . | . . . | . . . |
| Cumene | . . . | . . . | . . . | . . . | . . . | . . . | . . . | . . . |
| Σ C9—C9+ Aromatic compounds | 5.5 | 4.2 | 3.0 | 3.3 | 5.0 | 2.4 | 1.9 | 2.4 |
| Benzene (B) | 24.0 | 29.2 | 27.2 | 33.8 | 26.3 | 26.9 | 29.6 | 35.1 |
| Toluene (T) | 28.4 | 26.2 | 28.8 | 26.3 | 26.9 | 25.8 | 29.9 | 26.9 |
| Total | 100.0 | 100.0 | 100.0 | 100.0 | 100.0 | 100.0 | 100.0 | 100.0 |
| Σ BT | 52.4 | 55.4 | 56.0 | 60.1 | 53.3 | 52.7 | 59.5 | 62.0 |
| Selectivity to BT | 66.7 | 72.5 | 66.3 | 74.3 | 65.6 | 69.3 | 67.1 | 75.8 |
| Σ BTE | 63.9 | 62.2 | 76.6 | 74.9 | 64.7 | 62.4 | 78.7 | 77.4 |
| Selectivity to BTE | 80.9 | 81.4 | 90.6 | 92.6 | 79.6 | 82.0 | 88.7 | 94.6 |
| R(B/T) | 0.76 | 1.12 | 0.94 | 1.29 | 0.98 | 1.04 | 0.99 | 1.31 |
| R(BE/T) | 1.24 | 1.37 | 1.66 | 1.85 | 1.40 | 1.42 | 1.63 | 1.88 |

TABLE 3

| | Example | | |
|---|---|---|---|
| | 4 | 8 | 9 |
| Reaction temperature | 510° C. | 550° C. | 585° C. |
| Catalyst | B | B | B |
| Charge | 2 | 2 | 2 |
| Charge conversion (%) | 80.9 | 81.8 | 86.1 |
| Liquid effluent composition | weight % | weight % | weight % |
| Methane | 1.0 | 1.5 | 1.6 |
| Ethane (E) | 14.8 | 15.4 | 16.1 |
| Σ C3 | 3.3 | 2.5 | 1.8 |
| Σ C4-C5 | 0.1 | 0.1 | 0.1 |
| Ethyl benzene | 1.0 | 0.6 | 0.4 |
| o, m, p-xylene | 16.4 | 15.5 | 11.3 |
| Indane | . . . | . . . | . . . |
| Cumene | . . . | . . . | . . . |
| Σ C9—C9+ Aromatic compounds | 3.3 | 2.4 | 1.8 |
| Benzene (B) | 33.8 | 35.1 | 37.5 |
| Toluene (T) | 26.3 | 26.9 | 29.0 |
| Total | 100.0 | 100.0 | 100.0 |
| Σ BT | 60.1 | 62.0 | 66.5 |
| Selectivity to BT | 74.3 | 75.8 | 77.2 |
| Σ BTE | 74.9 | 77.4 | 82.6 |
| Selectivity to BTE | 92.6 | 94.6 | 95.9 |
| R(B/T) | 1.29 | 1.31 | 1.29 |
| R(BE/T) | 1.85 | 1.88 | 1.85 |

Under the same operating conditions, it can be observed (see Table 2, Examples 1-8) how, both at 510 and 550° C., the selectivity of the hydrodealkylation reaction to Benzene plus Toluene (BT, liquid-phase) or to Benzene plus Toluene plus Ethane (BTE, liquid phase and gas phase) is always the highest when the ZSM-5/Mo catalytic system is operating in the presence of $H_2O$ (Examples 4 and 8).

The B/T and BE/T ratios which can be considered as "main indexes" of the hydrodealkylation selectivity, give an immediate vision of this positive trend.

Table 3 (Examples 4, 5 and 9) and FIG. 1 enclosed, show how, under the same overall operating conditions, the temperature rise to 585° C. (Example 9) allows the conversion of the charge to be increased to values typical of tests with molybdenum alone. This conversion recovery is obtained as a result of a significant reduction in the residual concentration of xylenes and heavier aromatics ($C_9$-$C_{9+}$). The quantity of xylenes and higher aromatic products converted per single passage is such as to sustain their recycling to the reactor affluent.

The concentration of methane deriving from the hydrogenolysis of the aromatic ring (generally favoured at the highest temperatures), does not change significantly and in the tests with $H_2O$, it always remains substantially lower than that obtained with molybdenum alone. Furthermore, the contemporaneous reduction in heavier aromatic products ($C_9$-$C_{9+}$) minimizes the possibility of the formation of condensation side-reactions (also generally favoured at the highest temperatures) which create polycondensed aromatic products and coke which deactivate the catalyst.

All these results indicate the unexpected existence of an extremely strong synergy between the catalyst and $H_2O$ to the extent that the overall ZSM-5/Mo/$H_2O$ system should be considered as being the real reaction catalyst. The results relating to the conversion and selectivity and consequently also to the activity, indicate a surprising stability of the catalytic system with respect to degradation effects due to the presence of water also at high temperatures, unlike what is described in the known art.

The invention claimed is:

1. A process for the catalytic hydrodealkylation alone of hydrocarbon compositions comprising one or more $C_8$-$C_{13}$ alkylaromatic compounds, optionally in a mixture with $C_4$-$C_9$ aliphatic and cycloaliphatic products, including the processing in continuous of said hydrocarbon compositions, in the presence of water, with a catalyst consisting of a ZSM-5 zeolite having a molar ratio Si/Al ranging from 5 to 35, modified with at least one metal selected from the group consisting of a metal of group IIB, a metal of group VIB and a metal of group VIII, at a temperature ranging from 400 to 700° C., a pressure of between 2 and 4 MPa, and a molar ratio between $H_2O$/charge ranging from 3 to 6.

2. The process according to claim 1, wherein the catalytic hydrodealkylation reaction is carried out in the presence of water, previously vaporized and mixed with the hydrocarbon fraction in gas phase before the reactor inlet, or added to the liquid hydrocarbon fraction until its saturation at room temperature, or by a compound miscible with the charge and capable of releasing the water during the reaction.

3. The process according to claim 2, wherein the compounds capable of releasing water and generating aliphatic and/or aromatic hydrocarbon species of the same nature as those present in the liquid and gaseous phase of the reaction, are alcohols, ethers, esters, or their mixtures.

4. The process according to claim 3, wherein the compounds are ethanol or phenethyl alcohol.

5. The process according to claim 1, wherein the molar ratio between water and charge in the feeding to the reactor, ranges from 0.0006 to 0.16.

6. The process according to claim 1, wherein the hydrodealkylation reaction takes place at temperatures ranging from 450 to 600° C., pressures ranging from 2.8 to 3.6 MPa, $H_2$/charge molar ratios ranging from 3.8 to 5.2, and with such reagent flow-rates as to guarantee an LHSV (Liquid Hourly Space Velocity), calculated on the hydrocarbon stream, ranging from 3 to 5 $h^{-1}$, preferably from 3.5 to 4.5 $h^{-1}$.

7. The process according to claim 1, wherein the hydrocarbon charge subjected to hydrodealkylation comprises one or more $C_8$-$C_{13}$ alkylaromatic compounds selected from the group consisting of ethylbenzene, xylenes, propylbenzenes, ethyltoluenes, trimethylbenzenes, diethylbenzenes, ethylxylenes, tetramethylbenzenes, propyltoluenes, ethyltrimethylbenzenes, triethylbenzenes, and dipropyltoluenes.

8. The process according to claim 7, wherein the $C_8$-$C_{13}$ alkylaromatic hydrocarbon charge derives from reforming units or from units which effect pyrolytic processes, or from steam-cracking.

9. The process according to claim 1, wherein the hydrocarbon charge subjected to hydrodealkylation comprises $C_8$-$C_{13}$ alkylaromatic compounds optionally mixed with $C_4$-$C_9$ aliphatic and cycloaliphatic products and organic compounds containing hetero-atoms.

10. The process according to claim 1, wherein the catalyst consists of a ZSM-5 zeolite in bound form, with one or more binders selected from the group consisting of aluminas, pseudo-bohemite, and γ-alumina; clays, kaolinite, smectites, and montmorillonites; silica; aluminosilicates; titanium oxides; zirconium oxides; and mixtures thereof, with zeolite/binder weight ratios ranging from 100/1 to 1/10.

11. The process according to claim 1, wherein the ZSM-5/binder catalyst is modified with at least one metal selected from the group consisting of a metal of group IIB, a metal of group VIB and a metal of group VIII.

12. The process according to claim 11, wherein the metal is molybdenum.

13. The process according to claim 1, wherein the ZSM-5 zeolite has an Si/Al molar ratio ranging from 15 to 30.

14. The process according to claim 1, wherein the dispersion of metals on the catalyst is carried out by impregnation, ion exchange, vapor deposition or surface adsorption.

15. The process according to claim 1, wherein the ZSM-5 zeolite is impregnated with one or more of the metals of groups IIB, VIB and VIII by the steps of:

preparing one or more solutions of compounds of the metals;

impregnating the zeolite with the above solutions;

drying the impregnated zeolite:

calcining the zeolite at temperatures of between 400 and 650° C.; and optionally repeating the above steps one or more times.

16. The process according to claim 15, wherein the dispersion of the metals on the catalyst takes place by impregnation with an aqueous or aqueous-organic solution, the organic solvent being selected from alcohols, ketones and nitrites or their mixtures, containing at least one hydro- or organo-soluble compound of the metal in such concentrations that the total final content of the metal in the catalyst ranges from 0.1 to 10% by weight.

17. The process according to claim 1, wherein the total metal content in the catalyst ranges from 0.5 to 8% by weight.

18. The process according to claim 1, wherein the molar ratio between water and charge in the feeding to the reactor ranges from 0.003 to 0.032.

19. A process for the catalytic hydrodealkylation of a hydrocarbon composition, comprising:

continuously hydrodealkylating a hydrocarbon composition comprising one or more $C_8$-$C_{13}$ alkyl aromatic compounds;

wherein the hydrodealkylating includes contacting the $C_8$-$C_{13}$ hydrocarbon composition with a catalyst in the presence of water;

wherein the catalyst is a ZSM-5 zeolite having a molar ratio Si/Al of from 5 to 35 and wherein the catalyst is modified with at least one metal selected from the group consisting of a metal of group IIB, a metal of group VIB, and a method of group VII;

wherein the hydrodealkylating is carried out at a temperature of from 400 to 700° C., a pressure of from 2 to 4 MPa and a molar ratio $H_2O/C_8$-$C_{13}$ hydrocarbon composition of from 3 to 6.

20. The process according to claim 19, wherein the hydrodealkylating is carried out without transalkylating, isomerizing, disproportioning or condensing the $C_8$-$C_{13}$ hydrocarbon composition.

* * * * *